US012366080B2

(12) United States Patent
Graner

(10) Patent No.: US 12,366,080 B2
(45) Date of Patent: Jul. 22, 2025

(54) PORTABLE AND COLLAPSIBLE POOL

(71) Applicant: SPIN MASTER INC., Williamsville, NY (US)

(72) Inventor: Stephen C. Graner, Cranford, NJ (US)

(73) Assignee: SPIN MASTER INC., Williamsville, NY (US)

( * ) Notice: Subject to any disclaimer, the term of this patent is extended or adjusted under 35 U.S.C. 154(b) by 148 days.

(21) Appl. No.: 18/198,444

(22) Filed: May 17, 2023

(65) Prior Publication Data

US 2024/0384549 A1 Nov. 21, 2024

(51) Int. Cl.
*E04H 4/00* (2006.01)

(52) U.S. Cl.
CPC ..... *E04H 4/0037* (2013.01)

(58) Field of Classification Search
CPC ..... E04H 4/0018–0037
See application file for complete search history.

(56) References Cited

U.S. PATENT DOCUMENTS 5,429,437 A * 7/1995 Shaw ..... F16N 31/006 220/904
6,089,394 A * 7/2000 Ziglar ..... D06F 95/002 220/9.3
6,209,149 B1 * 4/2001 Song ..... E04H 15/20 4/503
6,851,136 B2 * 2/2005 Brereton ..... A47D 9/005 5/98.1
7,699,186 B2 * 4/2010 Zheng ..... E04H 4/0025 4/488
8,453,862 B2 * 6/2013 Wang ..... B65D 37/00 220/9.3
2015/0096980 A1 * 4/2015 Laing ..... B65D 90/24 220/9.4
2020/0240162 A1 * 7/2020 van den Bosch ..... E04H 4/108

* cited by examiner

*Primary Examiner* — Christine J Skubinna
(74) *Attorney, Agent, or Firm* — Aird & McBurney LP

(57) ABSTRACT

A collapsible pool is provided herein. The collapsible pool is provided as a pool with at least a top frame that supports a pool wall of the pool. The top frame is transformable between a top frame use position and a top frame storage position, where the top frame use and storage positions define distinct maximum cross-dimensions. The top frame of the pool is formed to be transformable between the top frame use and storage positions, and is supported in the top frame use position by a plurality of side struts. One end of each of the plurality of side struts being releasably securable to the top frame such that each of the plurality of side struts can pivot relative to the pool wall and top frame, where the pivoting of the side struts permits the collapsible pool to be moved between expanded and collapsed shapes.

18 Claims, 15 Drawing Sheets

PORTABLE AND COLLAPSIBLE POOL

FIELD OF THE DISCLOSURE

The present disclosure relates to portable and collapsible pool or bathing structures. In particular, the present disclosure relates to a collapsible pool structure.

BACKGROUND OF THE DISCLOSURE

It is well known within the art of aquatic toys to provide various portable pool structures, where the pool structures are transformable between a transportable configuration or shape where the pool structure can be easily carried from place to place, and a use configuration or shape where the pool can be filled with water and used. In some embodiments of these portable pool structures, the pool is essentially formed as an inflatable bladder, and has a valve for inflating/deflating the pool between storage and use positions.

It is also known to provide pool structures that include a frame structure and a pool canvas or sheet that is suspended by the frame structure to define a volume for holding the water of the pool.

In one example, U.S. Pat. No. 7,156,250 discloses such a pool structure, where the pool structure includes a collapsible, tub-shaped container for placing on a support. The tub-shaped container includes a base of flexible flat material and side walls of flexible flat material as well as a frame structure that supports the side walls of the flexible flat materials. The pool structure also includes connecting walls of flexible flat material arranged between the side walls. While this pool structure does provide for a collapsible pool, the structure of is complicated and does not provide for ease-of-use in collapsing and transforming the pool structure.

In another example, U.S. Patent Application No. 2010/0294759 discloses such a portable pool structure, where the portable pool structure is configurable between stored and erected conditions and includes one or more resilient frames, and multiple spacing members. The spacing members and frames both support a flexible pool wall material to form the body of the portable pool structure. In this example, the one or more resilient frames are bendable to allow the portable pool structure to be transformed between the stored and erected conditions.

SUMMARY OF THE DISCLOSURE

According to an aspect, there is provided a collapsible pool including a top frame, a flexible pool wall and a plurality of side struts. The top frame is transformable between a top frame use position where the top frame has a first top frame maximum cross-dimension and a top frame storage position where the top frame has a second top frame maximum cross-dimension that is less than the first top frame maximum cross-dimension. The flexible pool wall is positionable for containing a volume of water. The flexible pool wall including a sidewall and a base portion and is connected to the top frame. The plurality of side struts each includes a first end that is releasably connectable to the top frame and a second end that is pivotable between a support position for supporting the top frame in the top frame use position above the support surface and a stowage position in which the first end is disconnected from the top frame to permit transformation of the top frame from the top frame use position into the top frame storage position.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1A:
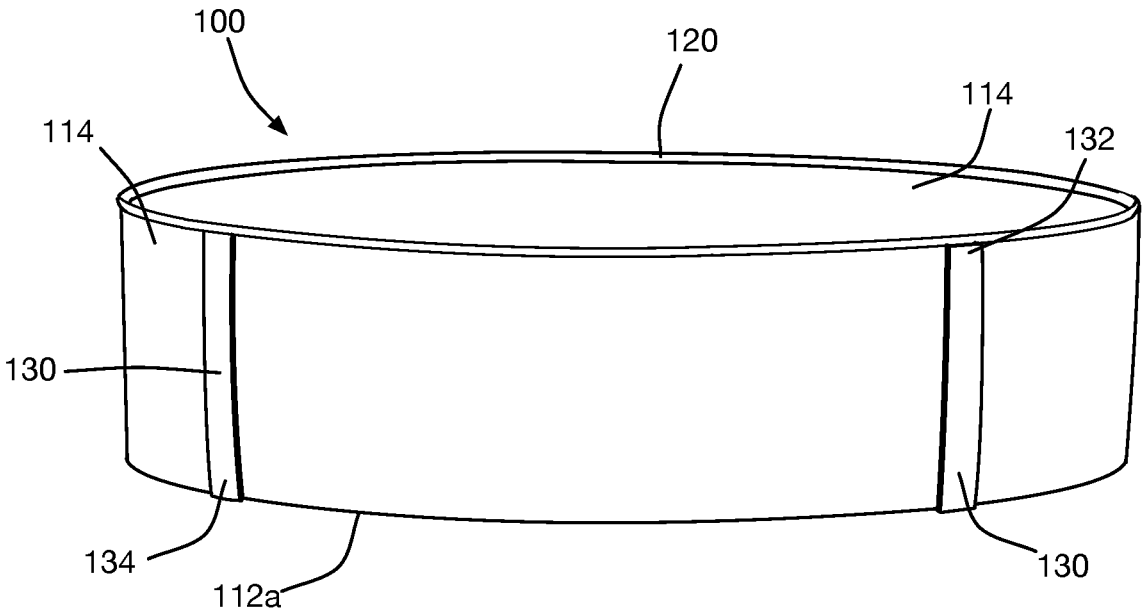
FIG. 1A shows a perspective view of an embodiment of the collapsible pool in accordance with an embodiment of the disclosure where the collapsible pool includes a top frame.

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. It will also be noted that the use of the term "a" or "an" will be understood to denote "at least one" in all instances unless explicitly stated otherwise or unless it would be understood to be obvious that it must mean "one".

Figure 1B:
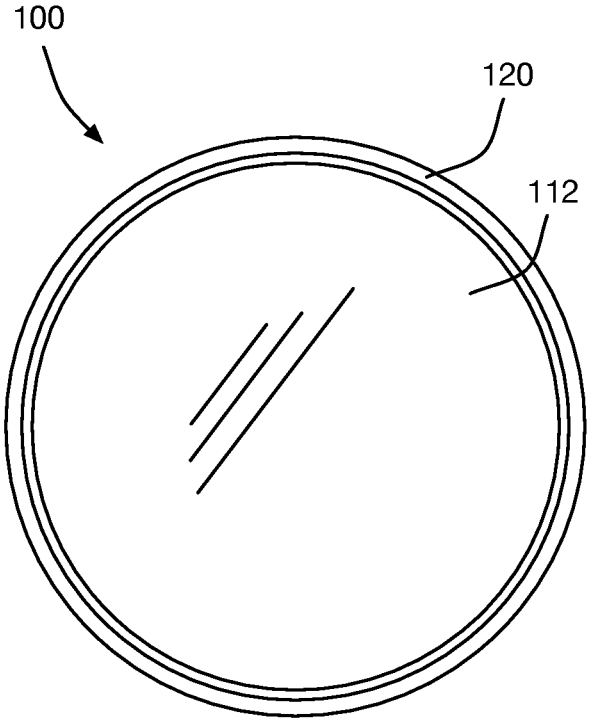
FIG. 1B shows a top view of the embodiment of the collapsible pool provided in FIG. 1A.
Figure 5A:
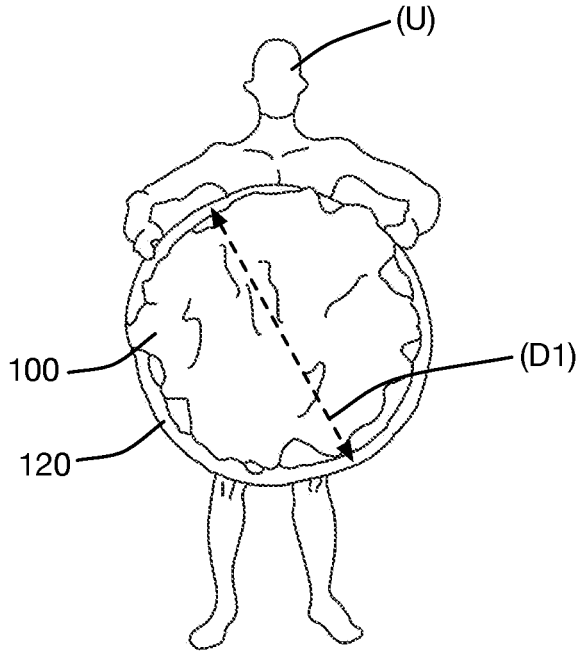
FIG. 5A shows a perspective view of a user holding the collapsed configuration or shape of the collapsible pool as provided in FIG. 4 where the top frame is in the top frame use position.

Referring to FIGS. 1A and 1B, there is provided an embodiment of a collapsible pool 100 for use on a support surface 104. The collapsible pool 100 includes a top frame 120 that is transformable between a top frame use position (see FIGS. 1A and 5A) where the top frame 120 has a first top frame maximum cross-dimension (D1) and a top frame storage position (see FIG. 5D) where the top frame 120 has a second top frame maximum cross-dimension (D2) that is less than the first top frame maximum cross-dimension (D1). A maximum cross-dimension is the largest cross-dimension across the top frame 120. In embodiments where the top frame 120 is perfectly circular, all the possible cross-dimensions across the frame are the same and are therefore all the maximum cross-dimension. However, if the top frame 120 has some other shape (e.g. ellipsoidal), then the maximum cross-dimension is the dimension across the major axis of the ellipse.

In an embodiment, the top frame 120 is formed as a resilient top frame.

The collapsible pool 100 also includes a flexible pool wall 110 for containing a volume of water. The flexible pool wall 110 includes a base 112, and a sidewall 114. The sidewall 114 is connected to the top frame 120. As shown in FIGS. 1A and 1B, the collapsible pool 100 also includes a plurality of side struts 130 which each include a first end 132 and a second end 134. The first end 132 of each of the plurality of side struts 130 is releasably connectable to the top frame 120 and the second end 134 of each of the plurality of side struts 130 is pivotable between a support position for supporting the top frame 120 in the top frame use position above the support surface 104, and a stowage position in which the first end 132 (of each side strut 130 of the plurality of side struts 130) is disconnected from the top frame 120 to permit transformation of the top frame 120 from the top frame use position into the top frame storage position.

In the embodiment provided in FIGS. 1A and 1B, the collapsible pool 100 is shown empty. It will be readily understood that the collapsible pool 100 may be readily filled with a volume of water.

In some embodiments, the collapsible pool 100 as disclosed herein is provided as a portable, collapsible pool 100, where all of the components of the collapsible pool 100 remain connected together (i.e. no component is fully separable from all of the other components) as part of the collapsible pool 100 as the collapsible pool 100 is expanded and collapsed. As a result, there is no need to store individual parts which could get lost when the collapsible pool 100 is not being used and is being stored. In other embodiments, some or all of the components of the collapsible pool 100 may be separable from the rest, thereby resulting in a plurality of separate pieces.

The collapsible pool 100 may have any cross-sectional shape, either regular or irregular, and still work in the same manner as disclosed herein.

In an embodiment, the collapsible pool 100 as disclosed herein is sized for use by young children and infants. In an exemplary embodiment of the toy collapsible pool 100, the first top frame 120 of the toy collapsible pool 100 is formed such that the first top frame maximum cross-dimension (D1) of the top frame 120 is no more than 3 feet.

In an embodiment, the top frame 120 of the collapsible pool 100 is formed as a resilient frame and is positioned for supporting the pool wall 110 in place while in use. As shown in FIGS. 1A, 1B, 2, 3 and 4, the top frame 120 is a frame that defines an outer edge of the collapsible pool 100. The top frame 120 can have a variety of shapes depending on the desired form of the collapsible pool 100 itself. For example, in the specific embodiments provided in FIGS. 1 to 8, the top frame 120 is a substantially circular top ring 320 with a circular ring cross-section. The top frame 120 in the form of the substantially circular top ring 320 provides a cylindrical shape of the collapsible pool 100 when the top frame 120 is in the top frame use position. In alternate embodiments, the top frame 120 may have a shape that is elliptical, rectangular or other similar, continuous polygon shapes. The top frame 120 is formed to support the pool wall 110 and to provide sufficient rigidity to the structure of the pool such that that a shape of the top frame 120 can define a cross-sectional shape of the collapsible pool 100.

In an embodiment, the top frame 120 is a continuous top frame 120 composed of a single, continuous top frame 120 element. Alternatively, the top frame 120 is a multi-part top frame 120 composed of a plurality of resilient top frame 120 members.

In an embodiment, the top frame 120 is formed as a resilient top frame 120, where the resilient top frame 120 is also flexible such that the top frame 120 is transformable between the top frame storage position and the top frame use position. The top frame 120 is composed of any one of spring steel, coiled spring steel, helically-wound spring steel, fibreglass, flexible plastics material, pre-stressed material, and/or other material which when bent, is resilient, and is therefore biased by its own resiliency towards a neutral position.

The "transformable" nature of the top frame 120 means that the top frame 120 can be manipulated against its own resiliency between the top frame use position and the top frame storage position. For example, the top frame 120 may be "transformed" by one or more actions of bending, twisting, and folding of the top frame 120.

In the exemplary embodiments provided in FIGS. 5A to 5D, the top frame 120 is the substantially circular top ring 320, where the substantially circular top ring 320 is sufficiently resilient so as to be bendable and twistable between a first circular shape that defines the top frame use position and a second, smaller circular shape that defines the top frame storage position. Further details of a method for transforming the top frame 120 between the top frame use position and top frame storage position are provided below with reference to FIGS. 5A to 5D.

As provided above, the pool wall 110 of the collapsible pool 100 includes the sidewall 114 and the base 112. The sidewall 114 and the base 112 are attached to each other to define the volume 102 within the pool wall 110 that will hold a fluid.

In an embodiment, the pool wall 110 is composed of at least one pool wall material, where the at least one pool wall material includes a flexible material. The at least one pool wall material is further configured as a waterproof and durable material such that water will not leak through the pool wall 110 during the use of the collapsible pool 100. The at least one pool wall material is also selected to be sufficiently durable such that the pool wall 110 will resist inadvertent tearing during normal use of the collapsible pool 100. It will be understood that various materials may be chosen which provide the required strength, durability and waterproof characteristics of the pool wall 110.

In an exemplary embodiment, the pool wall material includes a plastic fabric material such as polyvinyl chloride (PVC), polyethylene fabric, 180T polyester fabric or 230T polyester fabric. To provide waterproof characteristics to the pool wall 110, the plastic fabric material is lined with a waterproof coating such as a polyurethane coating.

In an embodiment, the sidewall 114 of the pool wall 110 and the base 112 of the pool wall 110 are composed of the same at least one pool wall material. Alternately, the sidewall 114 and the at least one base 112 are composed of different pool wall materials.

In an embodiment, the sidewall 114 and the base 112 of the pool wall 110 are formed from one continuous segment of pool wall material that has been worked to form the at least one sidewall and base portions 112, 114.

Alternatively, the sidewall 114 and the base 112 of the pool wall 110 are formed as individual segments of pool wall material, where the individual segments of pool wall material are welded or otherwise bonded together to form waterproof seals between respective segments of the pool wall material.

In an embodiment, the shape of the sidewall 114 and the shape of a perimeter edge 112*a* of the base 112 corresponds to the shape of the top frame 120 when the top frame 120 is in the top frame use position.

In the specific embodiments provided in FIGS. 1A and 1B, the sidewall 114 is attached around the perimeter edge 112*a* of the base 112. In this embodiment, the top frame 120 is the substantially circular top ring 320, the sidewall 114 is a single, cylindrical sidewall member and the base 112 is a circular base 112 with a circular perimeter edge 112*a*. A bottom edge of the single, cylindrical sidewall member is attached around the circular perimeter edge 112*a* of the base 112.

In an embodiment where the collapsible pool 100 includes the top frame 120 but no bottom frame 240 structure (see FIGS. 1A and 1B), the material of the pool wall 110 is an at least partially rigid material. In this embodiment, the pool wall material of the pool wall 110 is sufficiently rigid such that when the collapsible pool 100 is positioned with the top frame 120 in the top frame use position and the top frame 120 is supported in the top frame use position by the plurality of side struts 130 (where the plurality of side struts 130 are in the support position), the at least one sidewall 114 and base 112 of the pool wall 110 will substantially maintain their respective shapes so as to maintain the shape of the collapsible pool 100.

In an additional embodiment, the pool wall material is selected such that the base 112 and the sidewall 114 will retain their shapes when the collapsible pool 100 is not filled with water and when the collapsible pool 100 is at least partially filled with water.

In an alternate embodiment, the pool wall 110 is composed of at least one non-rigid pool wall material, where the pool wall material of the pool wall 110 is sufficiently non-rigid so as to not hold a consistent shape. In this way, the precise shape of the pool wall 110 and therefore the shape of the collapsible pool 100 will change as the pool wall 110 is at least partially filled with water.

In an embodiment, the top frame 120 is attached directly to the sidewall 114. The top frame 120 may be attached to a top side of the at least one sidewall, or it may be attached to inner or outer surfaces of the at least one sidewall.

In an alternate embodiment, the top frame 120 is connected to the sidewall 114 via at least one top pocket 524 that is formed on the at least one sidewall.

In an embodiment, the at least one top pocket 524 is sized to contain the top frame 120 such that the top frame 120 is effectively connected to the at least one sidewall 114. The at least one top pocket 524 extends along a length of the sidewall 114. The at least one top pocket 524 is also be sized to receive and releasably hold the at least a portion of the top frame 120 therewithin.

In the specific embodiments provided in FIGS. 1A and 1B, the top frame 120 is the circular top frame 120 with a circular cross-section, and the top pocket 524 is a single pocket formed on a top end of the sidewall 114. The top pocket 524 is formed to be a single continuous pocket which entirely encloses the circular top frame 120.

As provided above, the collapsible pool 100 includes the plurality of side struts 130 that are pivotably connected for pivoting between the support position and the storage position. When in the support position, each of the plurality of side struts 130 functions to support the top frame 120 in the top frame use position. The plurality of side struts 130 also function to provide support to the sidewall 114 of the pool wall 110 so as to prevent the collapsing thereof, and so as to maintain the overall shape of the collapsible pool 100 when the collapsible pool 100 is empty and when the collapsible pool 100 is at least partially filled with water.

The plurality of side struts 130 are formed as semi-rigid structures that are sufficiently rigid so as to support the top frame 120 in the use position.

In an embodiment, each of the plurality of side struts 130 are composed of any one of plastic, nylon, glass fiber or a combination or mixture thereof.

Figure 2:
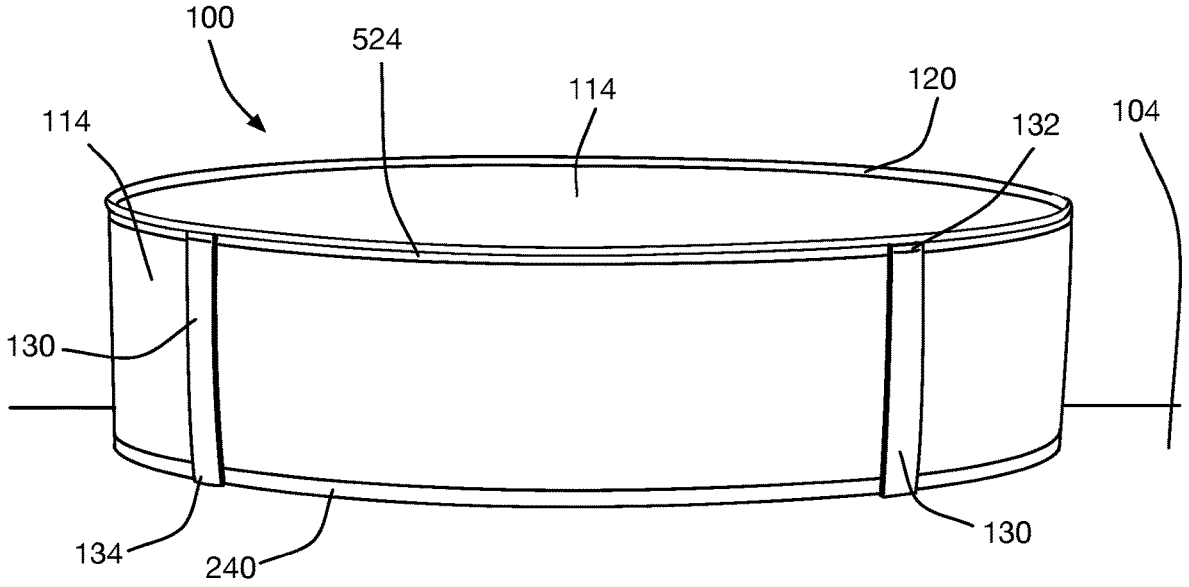
FIG. 2 shows a perspective view of an embodiment of the collapsible pool in accordance with an embodiment of the disclosure where the collapsible pool includes both a top frame and a bottom frame.
Figure 3:
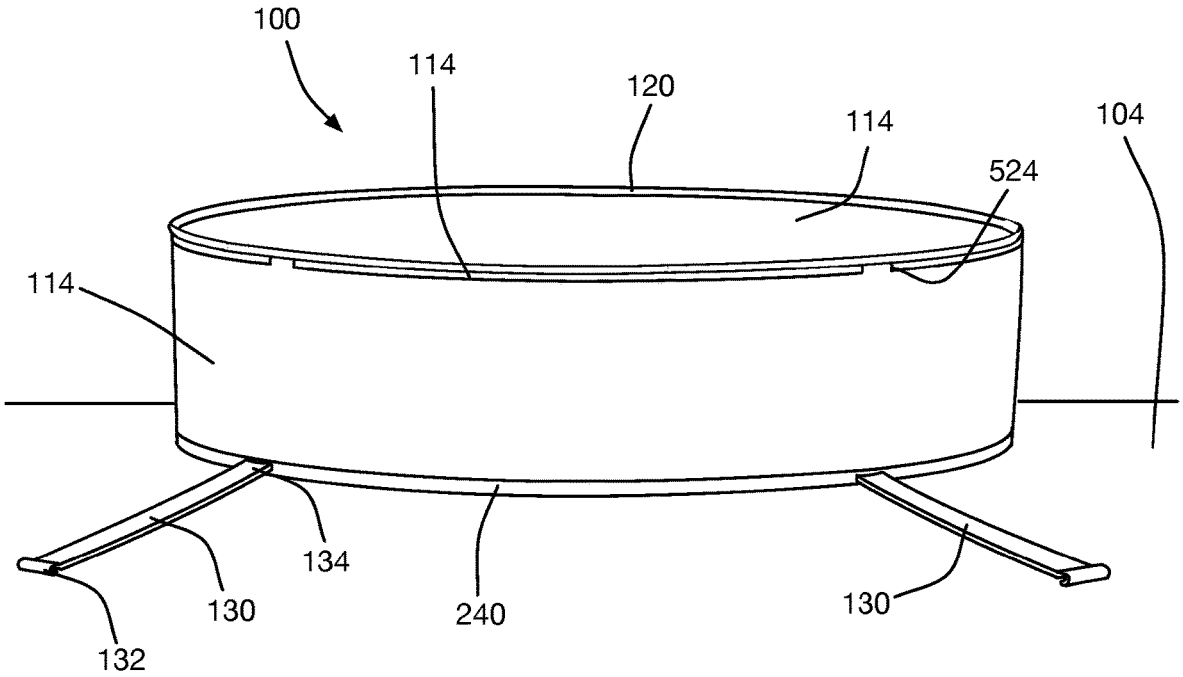
FIG. 3 shows a perspective view of the embodiment of the collapsible pool provided in FIG. 2 where each of the plurality of side struts have been pivoted from the support position.

In the specific embodiment provided in FIGS. 1A, 2 and 3, the plurality of side struts 130 are formed as elongated side struts that each include a first end 132 and a second end 134 with an elongated strut body 138 extending therebetween. Each of the plurality of side struts 130 extend substantially vertically relative to the support surface 104 when in the support position. The plurality of side struts 130 extend at an angle relative to the support surface 104 when pivoted from the support surface 104 towards the storage position.

In an embodiment such as provided in FIGS. 1A and 1B, the plurality of side struts 130 are evenly spaced around the sidewall 114 of the pool wall 110 and extend (when in a use position), from the base 112 of the pool wall 110 to a top edge of the sidewall 114.

In the specific embodiment provided in FIG. 1A, the plurality of side struts 130 are formed as four side struts 130 that are evenly spaced around the collapsible pool 100 such that each of the four side struts 130 diametrically opposes another one of the four side struts 130.

Figure 5B:
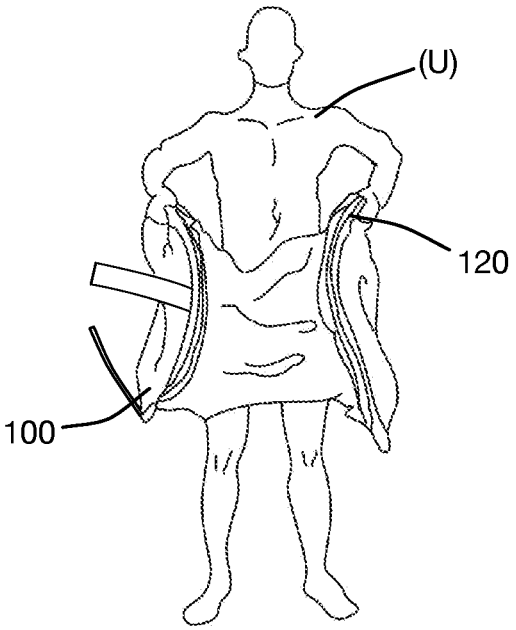
FIG. 5B shows a perspective view of a user holding the collapsed configuration or shape of the collapsible pool of FIG. 5A where the user is bending diametrically opposed portions of the top frame towards one another.
Figure 5C:
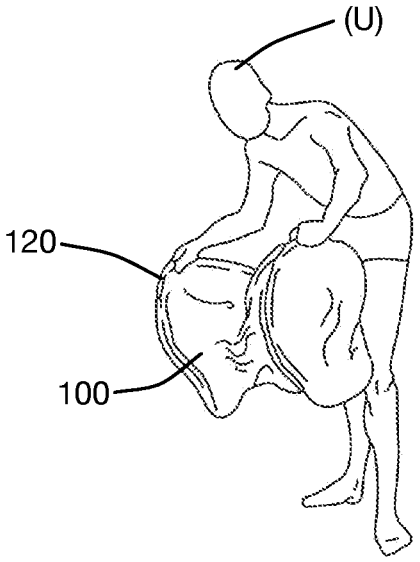
FIG. 5C shows a perspective view of the user holding the collapsed configuration or shape of the collapsible pool of FIG. 5A where the user is folding one of the diametrically opposed portions of the top frame under the other diametrically opposed portion of the top frame.
Figure 5D:
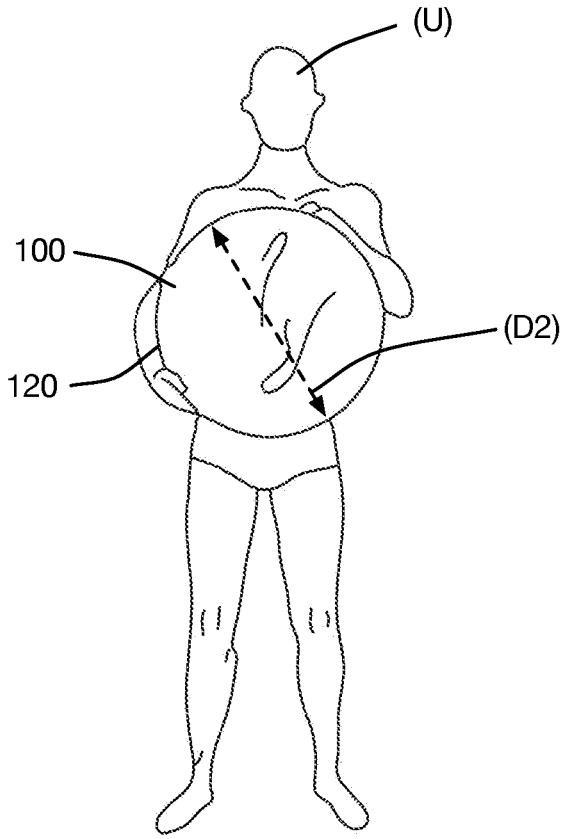
FIG. 5D shows a schematic view of the user holding the collapsed configuration or shape of the collapsible pool of FIG. 5A where the top frame has been transformed into the top frame storage position.
Figure 5E:
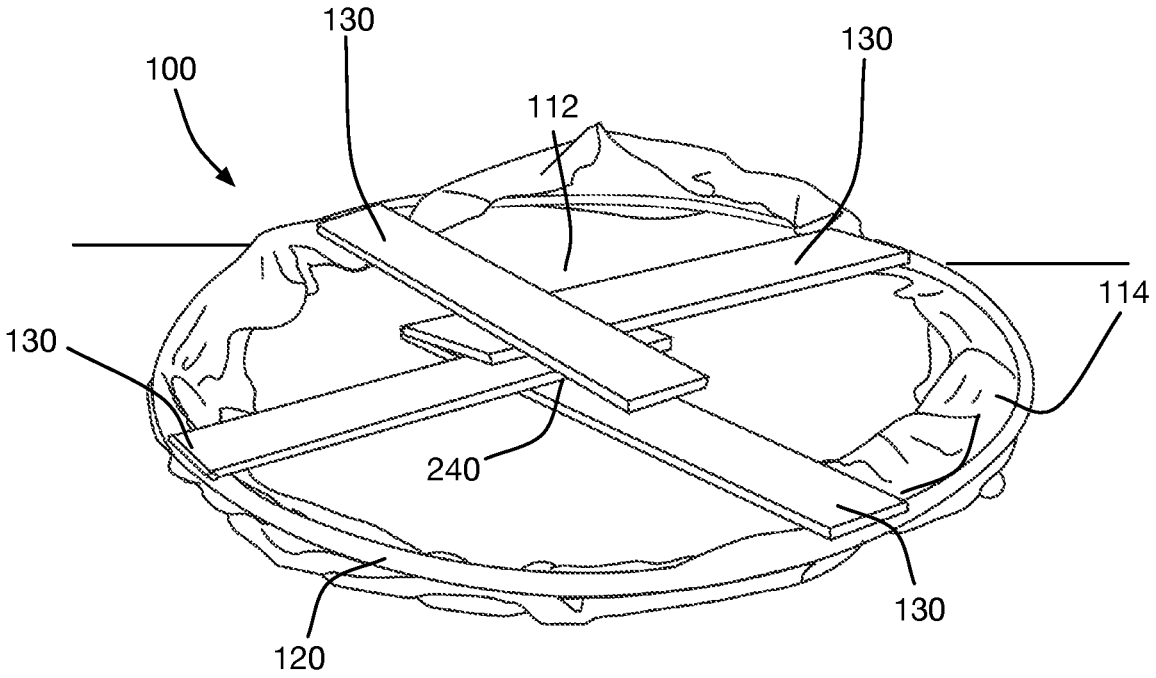
FIG. 5E shows a perspective view of the embodiment of the collapsible pool provided in FIG. 4A where the top frame is in the top frame storage position, and where the plurality of side struts have been pivoted onto one side of the collapsed, transformed configuration or shape of the collapsible pool.

In an additional embodiment, each of the plurality of side struts 130 are sized such that a length of each of the side struts 130 is less than the second top frame maximum cross-dimension (D2) of the top frame 120 (with reference to FIG. 5E).

Regarding the first ends 132 of the plurality of side struts 130, various structures can be provided as part of the first end 132 of each of the plurality of side struts 130 so as to facilitate the releasable, securing connection of the first end 132 to the top frame 120.

Figure 6A:
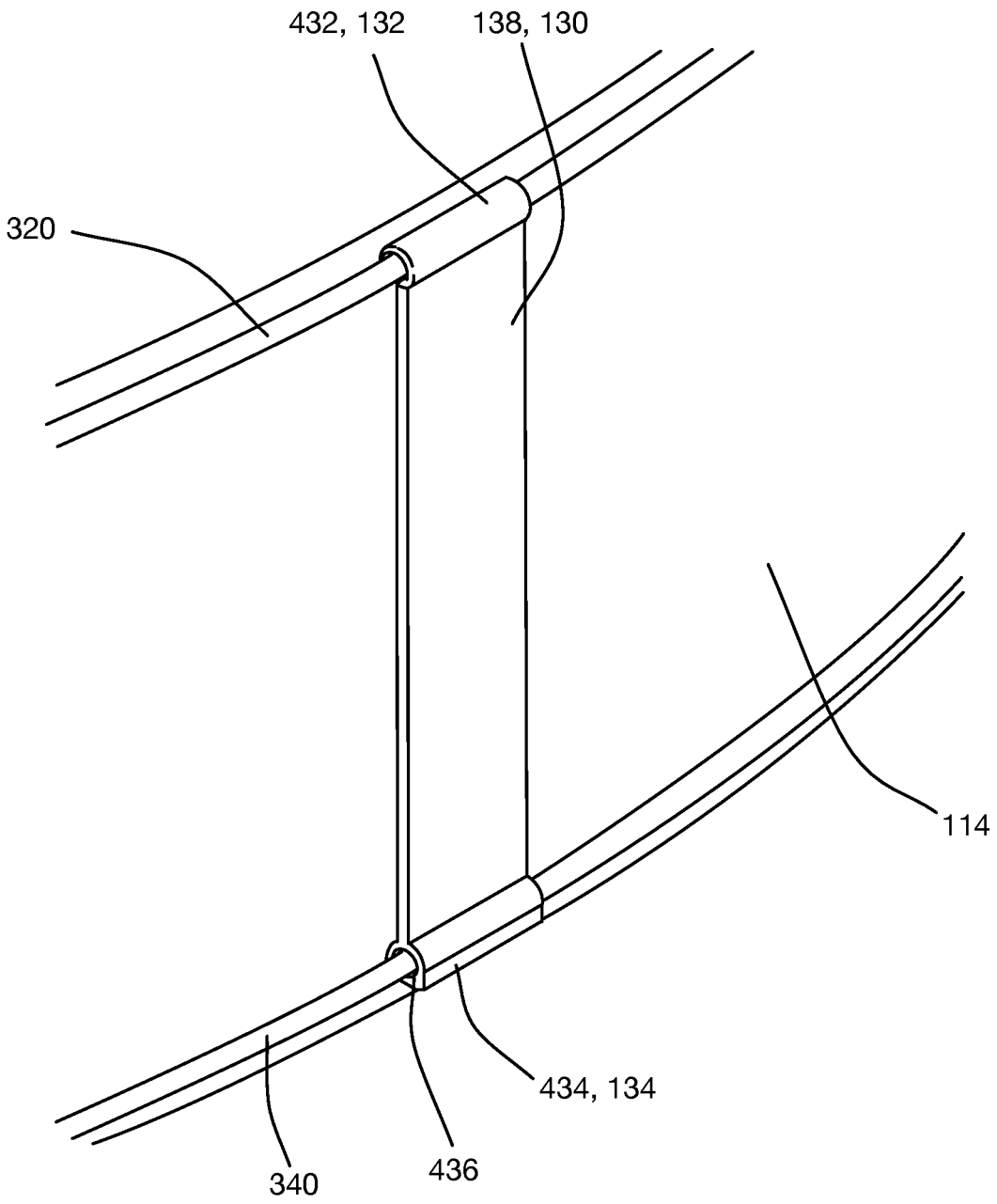
FIG. 6A shows a perspective view of an embodiment of one of the plurality of side struts where the one of the plurality of side struts is in the support position.
Figure 6B:
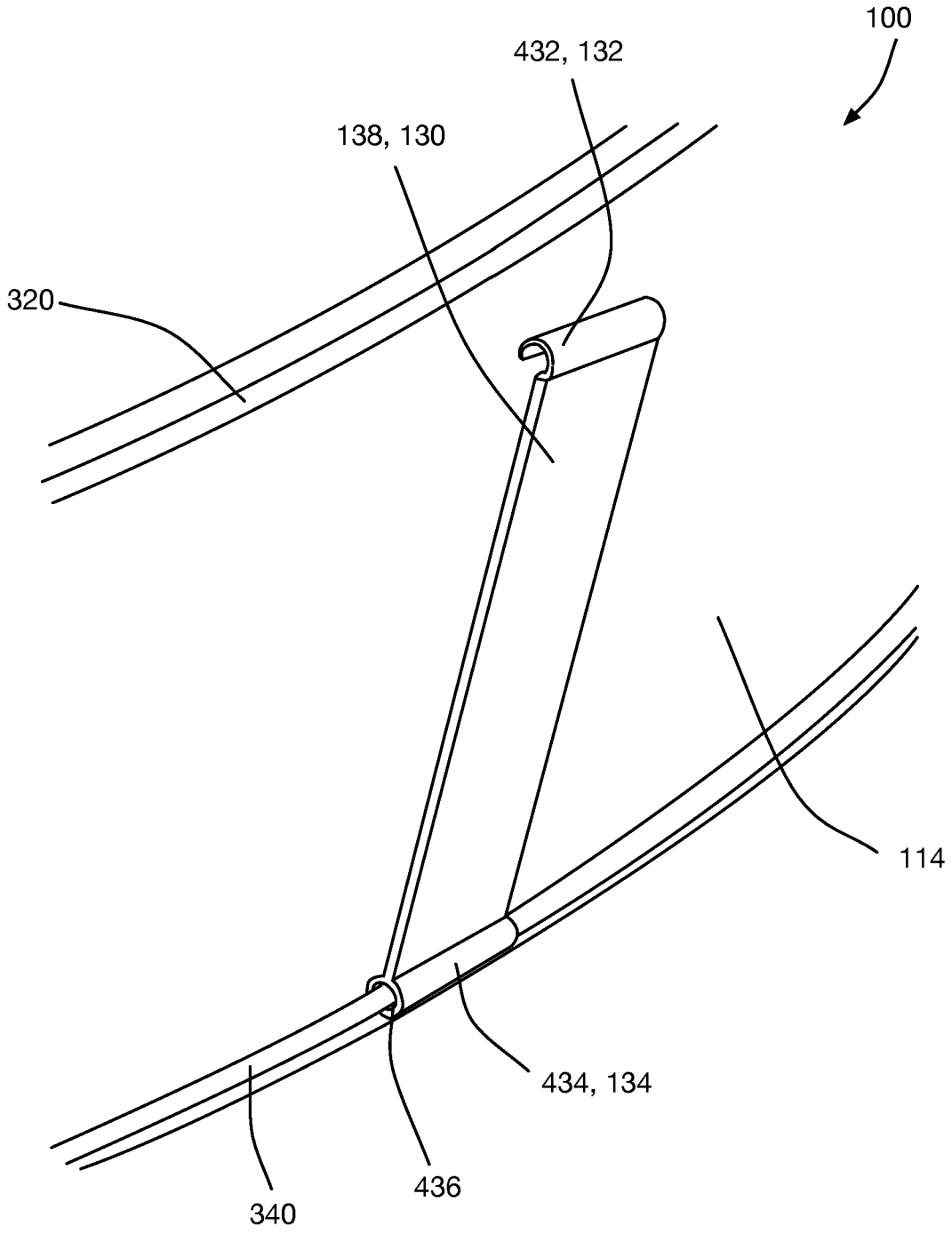
FIG. 6B shows a perspective view of the embodiment of one of the plurality of side struts provided in FIG. 6A where the one of the plurality of side struts is pivoted towards the stowage position.

In an embodiment such as shown in FIGS. 6A and 6B, the first end 132 of each of the plurality of side struts 130 includes a side-facing hook member 432 where an opening of the hook shape on this hook member is on a lateral side of the strut 130, and where the hook member 432 that is sized to releasably connect around the top frame 120. Thus, the first end 132 may be said to be connectable to the top frame 120. The hook member 432 may be secured to the top frame 120 to secure the side strut in the support position (FIG. 6A) and may be disconnected from the top frame 120 such that the side strut can be pivoted towards the storage position (FIG. 6B). As shown in FIG. 6B, the hook member 432 extends along a width of each of the plurality of side struts 130 for providing an extended gripping surface on the first end 132 of each of the plurality of side struts 130.

Figure 6C:
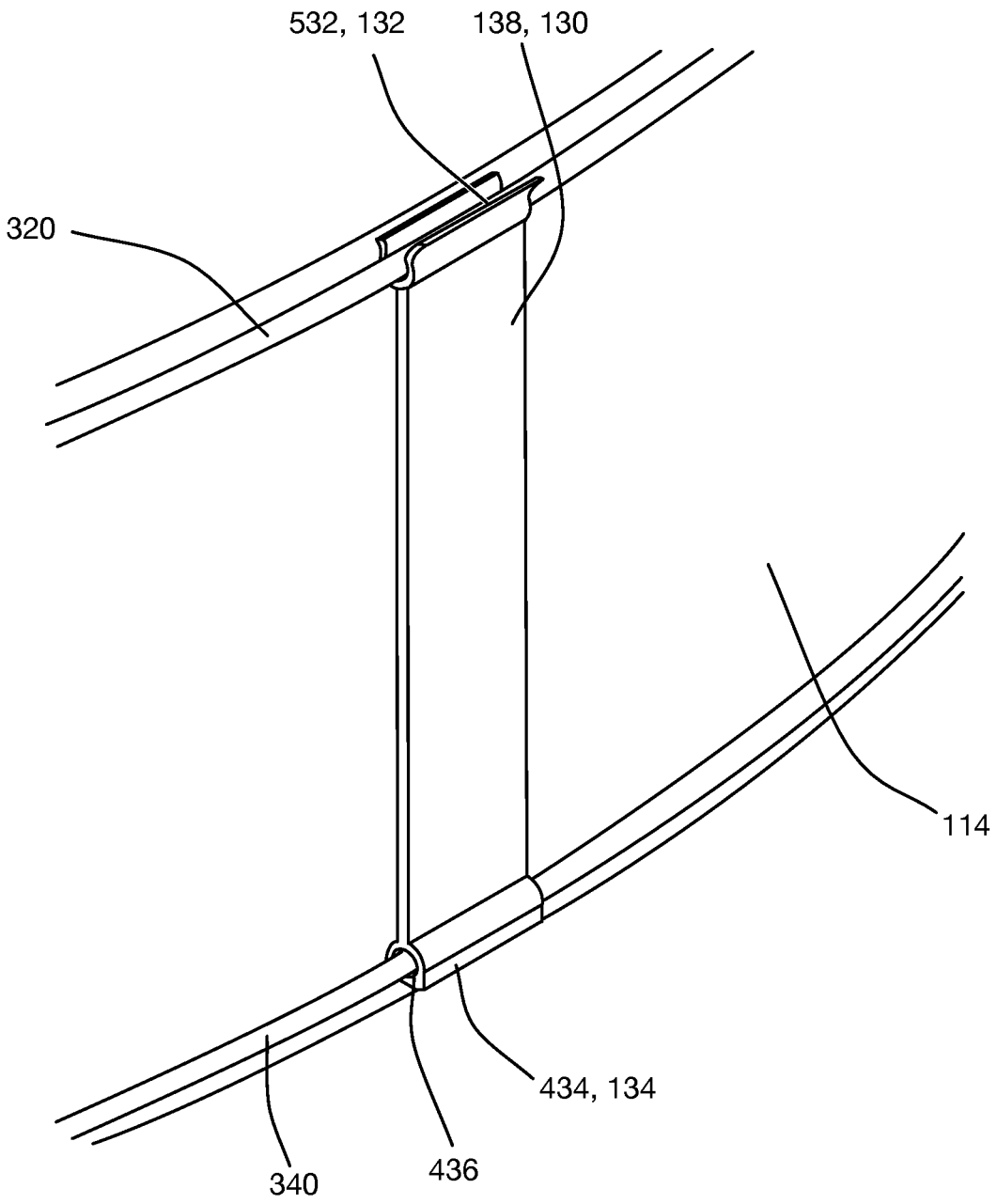
FIG. 6C shows a perspective view of an alternate embodiment of one of the plurality of side struts where the one of the plurality of side struts is in the support position.
Figure 6D:
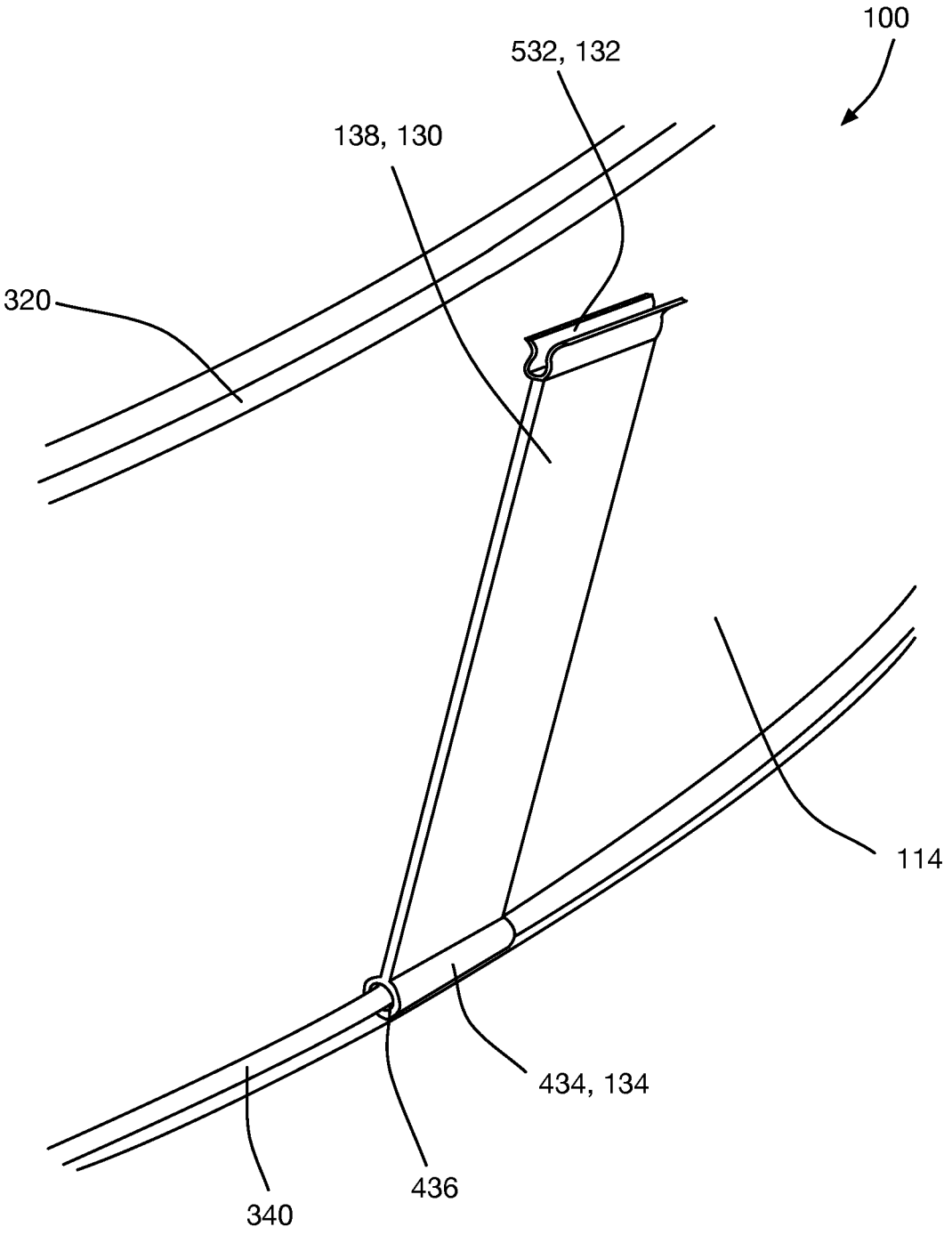
FIG. 6D shows a perspective view of the alternate embodiment of one of the plurality of side struts provided in FIG. 6C where the one of the plurality of side struts is pivoted towards the stowage position.

In an alternate embodiment of the plurality of side struts 130 shown in FIGS. 6C and 6D, the first end 132 of each of the plurality of side struts 130 includes an open-top hook element 532, where a cross section of the open-top hook element 532 has a substantially "u-shaped" profile such that the opening through which the top frame is received is positioned on the top of the hook element 532. As shown in FIGS. 6C and 6D, the hook element 532 may be secured to the top frame 120 to secure the side strut 130 in the support position (FIG. 6C) and may be disconnected from the top frame 120 such that the side strut 130 can be moved (e.g. pivoted) towards the storage position (FIG. 6D). As shown in FIG. 6D, the hook element 532 extends along a width of each of the plurality of side struts 130 for providing an extended gripping surface on the first end 132 of each of the plurality of side struts 130. The open top hook element 532 is merely one example of a suitable connection structure on the first end 132 of the side strut 130. It will be noted that any other suitable connection structure may alternatively be provided on the first end 132 of each side strut 130, in order to releasably connect the side strut 130 to the top frame 120.

Regarding the second ends 134 of the plurality of side struts 130, various structures may be provided as part of the second end 134 of each of the plurality of side struts 130 so as to facilitate the pivoting of each of the plurality of side struts 130 about the second ends 134 thereof.

In an embodiment such as shown in FIG. 1A, the second end 134 of each of the plurality of side struts 130 is pivotably connected to the pool wall 110 itself. In the specific embodiment provided in FIG. 1A, the second end 134 of each of the plurality of side struts 130 are attached directly to a bottom region of the sidewall 114 such that each of the plurality of side struts 130 are pivotable relative to the sidewall 114.

In an alternate embodiment such as shown in FIGS. 2 to 8, the second end 134 of each of the plurality of side struts 130 are pivotably connected to a bottom frame 240 of the pool. Further details as to the form and function of the bottom frame 240 of the collapsible pool 100 are provided below with specific reference to FIGS. 2, 6A, 6B and 7.

In the specific embodiments provided in FIGS. 6A and 6B the second end 134 of each of the plurality of side struts 130 includes a cylindrical protrusion 434 with a circular through-channel 436 extending therethrough. The through-channel 436 of each second end 134 is sized to pivotably connect to the bottom frame 240 such that each of the plurality of side struts 130 can pivot about the bottom frame 240.

Figure 4:
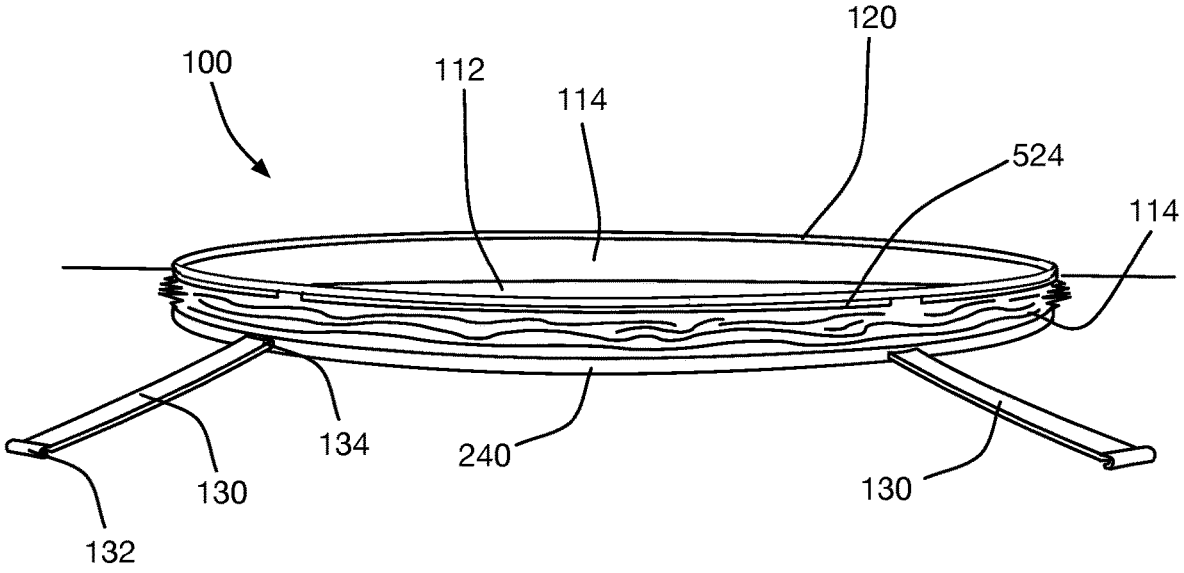
FIG. 4 shows a perspective view of the embodiment of the collapsible pool provided in FIG. 2 where each of the plurality of side struts have been pivoted from the support position and the pool wall and top frame have been collapsed.

As part of the transforming the top frame 120 between the top frame use position and the top frame storage position, the structure of the collapsible pool 100 is collapsible on itself to provide for easier manipulation of the entire structure of the collapsible pool 100 during the transformation of the top frame 120. In moving each of the plurality of side struts 130 from the support position towards the storage positions, the collapsible pool 100 can be collapsed on itself. FIGS. 2, 3, and 4, illustrate steps for collapsing the collapsible pool 100 on itself. As shown in FIG. 2, when the top frame 120 is supported in the top frame use position by the plurality of side struts 130, the collapsible pool 100 may have a generally cylindrical shape. As disclosed previously, the plurality of side struts 130 are each releasably connected to the top frame 120 in the support position, and the sidewall 114 extends between the circular top frame 120 and a perimeter edge of the base 112 of the flexible pool wall 110.

As presented above, each of the plurality of side struts 130 is disconnected from the top frame 120 such that each of the plurality of side struts 130 can pivot from the support position to the stowage position. In the embodiment provided in FIG. 3, the stowage position of each of the plurality of side struts 130 is a position where each side strut is pivoted approximately ninety degrees relative to the support position. In the specific embodiment of FIG. 3, the collapsible pool 100 rests on the support surface 104 and the plurality of side struts 130 have been pivoted such that each of the plurality of side struts 130 lies flat on the support surface 104, in the stowage position.

With the plurality of side struts 130 no longer supporting the top frame 120 in the support position, the top frame 120 can that be urged downwards towards the base 112 of the pool wall 110 such that the sidewall 114 of the collapsible pool 100 collapses on itself, thereby providing the relatively flat and compact shape of the collapsible pool 100 as shown in FIG. 4. When the collapsible pool 100 is in this flat and compact shape, the top frame 120 is said to be in a top frame collapsed position.

Once the collapsible pool 100 has been collapsed into this flat and compact structure and the top frame 120 is in the top frame collapsed position, the collapsible pool 100 is further transformed by deforming the top frame 120 from the top frame 120 collapsed position into the top frame storage position.

The mechanism by which the collapsible pool 100 is further transformed by deforming the top frame 120 from the top frame collapsed position into the top frame storage position will now be described with reference to FIGS. 5A to 5D.

FIGS. 5A to 5D show schematic views of a method of transforming the collapsible pool 100 of the previous embodiments and is illustrated in particular with reference to the structure of FIGS. 1A and 1B. In FIGS. 5A to 5D, the top frame 120 is the resilient, substantially circular top ring. The first circular shape of the top frame 120 defines the first top frame maximum cross-dimension (D1) and the second circular shape of the top frame 120 defines the second top frame maximum cross-dimension (D2). Various states of operation during the transforming of the collapsible pool 100 are shown in FIGS. 5A through 5D.

To transform the top frame from the top frame use position to the top frame storage position, a user (U) grabs opposing sections of the top frame (see FIG. 5A) 120. Next, as depicted in FIG. 5B, the user applies force to the opposing sections of the top frame to bring diametrically opposed regions of the top frame towards one another. The top frame 120 is sufficiently resilient such that as the diametrically opposed regions of the top frame 120 are pushed towards one another, the top frame 120 will become bent (as shown in FIG. 5B). In a next step shown in FIG. 5C, as the diametrically opposed regions of the top frame 120 are brought close together by bending the top frame 120, the top frame 120 is twisted, and one of the diametrically opposed regions is "tucked" under the other diametrically opposed regions as the diametrically opposed regions are brought still closer together. The top frame 120 is formed to be substantially flexible so that as the one diametrically opposed region is tucked under the other, the top frame 120 will twist to take up a shape where the top frame 120 will take on a substantially closed helical shape such that the top frame 120 is effectively coiled upon itself.

The coiling of the top frame 120 upon itself provides for a smaller, circular form of the top frame 120 that corresponds to the second top frame maximum cross-dimension (D2) (see FIG. 5D). The coiled top frame 120 can then be compressed against the resistance provided by the resilience of the top frame 120 such that the collapsible pool 100 takes on a substantially flattened shape. When the collapsible pool 100 takes on this substantially flattened shape, the top frame 120 is considered to be in the top frame storage position (see FIG. 5D).

Said another way, as the top frame 120 is transformed into the top frame storage position, the top frame 120 becomes coiled upon itself and has a second shape with the second top frame maximum cross-dimension (D2) (see FIG. 5D).

In an additional embodiment, the top frame 120 is formed such that when the top frame 120 is transformed to the top frame storage position, the top frame 120 is coiled on itself in at least two turns.

In an embodiment, the collapsing of the collapsible pool 100 and the transforming of the top frame 120 from the top frame use position to the top frame storage position includes a step of folding the plurality of side struts 130 in with the rest of the collapsed structure of the collapsible pool 100. As shown in FIG. 5E, the collapsible pool 100 is in a collapsed state with the top frame 120 in the top frame storage position. In this embodiment, the plurality of side struts 130 have been pivoted relative to the pool wall 110 and top frame 120. The plurality of side struts 130 are each pivoted until they reach the positions provided in FIG. 5E, where the plurality of side struts 130 extend radially inwards and lie substantially flat along one or more side of the collapsed, collapsible pool 100. The plurality of side struts 130 can be pivoted to lie flat along only one side of the collapsed pool (see FIG. 5E), or the plurality of side struts 130 can be pivoted to both sides of the collapsible pool 100 such that some of the plurality of side struts 130 lie against one side of the collapsible pool 100, and the rest of the plurality of side struts lie against the other side of the collapsible pool 100.

In a previously described embodiment, the collapsible pool 100 is formed such that a length of each of the plurality of side struts 130 is less than the second top frame maximum cross-dimension (D2) of the top frame 120. In this embodiment, the length of each of the plurality of side struts 130 is provided as less than the second maximum cross-dimension such that when the collapsible pool 100 is collapsed, and the top frame 120 is transformed from the top frame use position to the top frame storage position and the plurality of side struts 130 are folded to extend radially inwards and lie flat on the one or more sides of the collapsible pool 100, the plurality of side struts 130 do not extend beyond a perimeter of the top frame 120 in the top frame storage position. In other words, each of the plurality of side struts 130 extends from the second end 134 across the collapsible pool 100, at most up to a perimeter of the top frame 120 in the top frame storage position, i.e. such that the first end 132 does not extend beyond the perimeter of the top frame 120, thereby provided a more compact shape to the collapsible pool 100 when the top frame 120 is in the top frame storage position.

In an embodiment such as shown in FIGS. 2, 3, 4, 6A, 6B and 7, the collapsible pool 100 includes the bottom frame 240. The bottom frame 240 of the collapsible pool 100 is connected to at least one of the base 112 and the sidewall 114.

As shown in FIG. 2, the bottom frame 240 is connected to at least one of the base 112 and sidewall 114 such that it is in a vertically spaced relationship with the top frame 120. The bottom frame 240 supports the bottom region of the sidewall 114 and the base 112 such that a form of the collapsible is maintained during the use of the pool. Like the top frame 120, the bottom frame 240 is transformable between a bottom frame use position where the bottom frame 240 has a first bottom frame maximum cross-dimension that corresponds to the first top frame maximum cross-dimension (D1), and a bottom frame storage position where the bottom frame 240 has second bottom frame maximum cross-dimension that corresponds to the second top frame maximum cross-dimension (D2).

In an embodiment, the bottom frame 240 is a continuous bottom frame 240 composed of a single, continuous bottom frame 240 element. Alternatively, the bottom frame 240 is a multi-part bottom frame 240 composed of multiple, resilient bottom frame 240 members.

In an embodiment where the top frame 120 is formed as a resilient top frame 120, the bottom frame 240 may also formed as a resilient bottom frame 240. In the specific embodiment provided in FIGS. 2 to 8, each of the top frame 120 and bottom frame 240 are formed as resilient rings such that each of the top frame 120 and bottom frame 240 have a circular cross-sectional shape, and the top frame 120 and bottom frame 240 are similarly resilient.

Like the top frame 120, the "transformable" nature of the bottom frame 240 defines various means by which the bottom frame 240 can be driven between the bottom frame use position and bottom frame storage position. The bottom frame 240 can be formed as a sufficiently resilient and flexible frame so as to be bent, twisted or folded to between the bottom frame storage and the bottom frame use position.

In the embodiments where the collapsible pool 100 includes both the top and bottom frames 120, 240, the bottom frame 240 is transformed in substantially the same manner as the top frame 120 as provided above with reference to FIGS. 5A to 5D. The bottom frame 240 is formed to move in tandem with the top frame 120 such that when the top frame 120 is in the top frame use position, the bottom frame 240 is similarly in the bottom frame use position, and when the top frame 120 is in the top frame storage position, the bottom frame 240 is provided in the bottom frame storage position. It will be readily understood that when the bottom frame 240 is a resilient bottom frame 240 that is composed of similar material and has a similar shape to that of the top frame 120, then the bottom frame 240 will be transformable, in tandem with the top frame 120, such that both the top and bottom frame 240*s* simultaneously transform from the top/bottom frame use positions to the top/bottom frame storage positions.

In an embodiment, the bottom frame 240 is attached directly to at least one of the sidewall 114 and the base 112 of the pool wall 110. The bottom frame 240 is preferably connected to the base 112 and sidewall 114 of the pool wall 110 at a perimeter edge of the base 112.

In various additional embodiments where the bottom frame 240 is directly attached to the sidewall 114 and base 112, the bottom frame 240 is attached to only a bottom region of the sidewall 114, only to the perimeter edge 112*a* of the base 112, or both the bottom region of the at least one sidewall 114 and the perimeter edge 112*a* of the base 112. In an alternate embodiment, the bottom frame 240 is connected to the sidewall 114 via at least one bottom pocket 534 that is formed on the sidewall 114. The at least one bottom pocket 534 extends along a length of the sidewall 114. The at least one bottom pocket 534 is sized to receive and releasably hold at least a portion of the bottom frame 240 therewithin.

The at least one bottom pocket 534 is sized to contain bottom frame 240 such that the bottom frame 240 is effectively connected to the sidewall 114. The at least one bottom pocket 534 may be formed at various locations on the sidewall 114 and the base 112 of the pool wall 110.

In an exemplary embodiment, the at least one bottom pocket 534 is formed at an interface of base 112 and the sidewall 114. In this embodiment, the at least one bottom pocket 534 is formed partially by material of the sidewall 114 and partially by material of the base 112.

As with the at least one top frame 120 pocket, the at least one bottom pocket 534 can be formed as a singular pocket that fully surrounds and encloses the bottom frame 240. Alternatively, the at least one bottom pocket 534 can be formed as a plurality of distinct bottom pockets 534.

Figure 7:
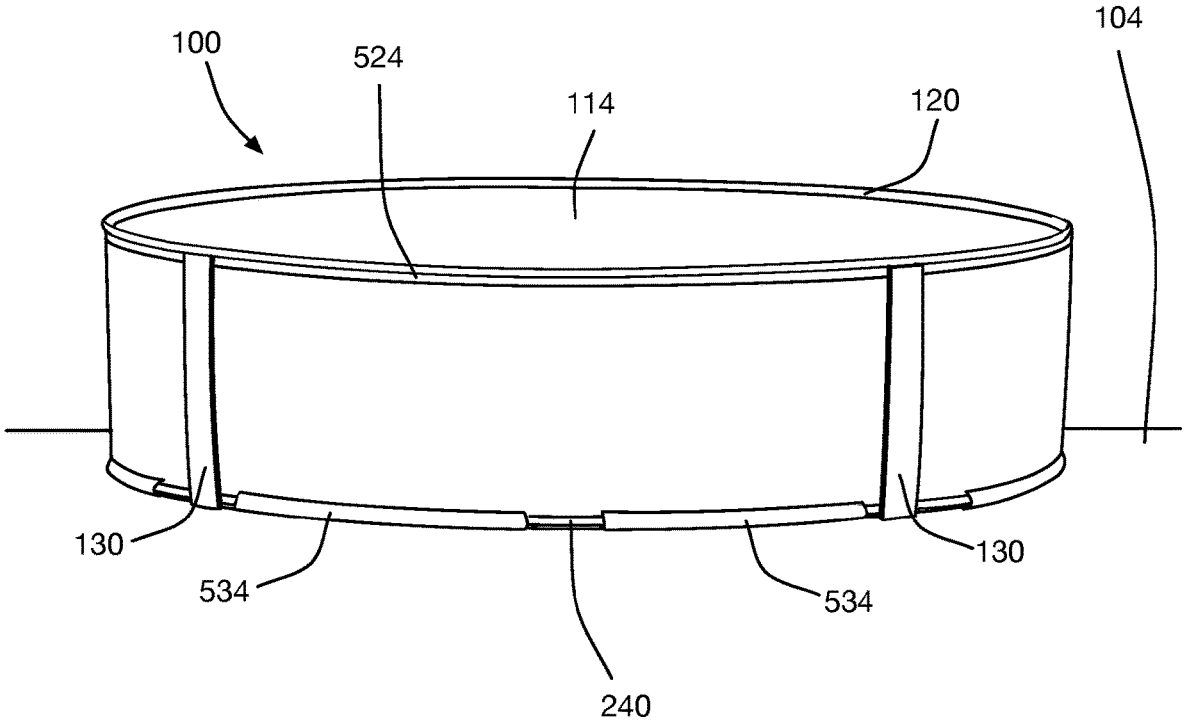
FIG. 7 shows a perspective view of an embodiment of the collapsible pool in accordance with an embodiment of the disclosure where the collapsible pool includes a top frame and a bottom frame that is connected to the pool wall via a plurality of bottom pockets.

In the specific embodiments provided in FIGS. 7, the bottom frame 240 is a substantially circular bottom ring 340 with a circular cross-section, and the bottom pocket 534 is a plurality of pockets that are formed along the bottom region of the sidewall 114. The bottom pockets 534 are formed to partially surround the substantially circular bottom ring 340 such that lengths of the circular bottom ring 340 are exposed between adjacent bottom pockets 534.

In an additional embodiment, the second ends 134 of the plurality of side struts 130 are attached to at least some of the lengths of the substantially circular bottom ring 340 that are exposed between adjacent bottom pockets 534.

The collapsible pool 100 of the present disclosure provides for various sizes of the top and bottom frames 120, 240, as well as various relative sizes of the top and bottom frames 120, 240.

In an embodiment, the bottom frame 240 is formed such that the first bottom frame maximum cross-dimension is less than the first top frame maximum cross-dimension (D1) of the top frame 120. Alternatively, the bottom frame 240 is formed such that the first bottom frame maximum cross-dimension of the bottom frame 240 is substantially the same as the first top frame maximum cross-dimension (D1) of the top frame 120.

In yet another embodiment, the bottom frame 240 is formed such that the second bottom frame maximum cross-dimension of the bottom frame 240 is substantially the same as the second top frame maximum cross dimension (D2) of the top frame 120.

In an embodiment, the bottom frame 240 is composed of any one of spring steel, coiled spring steel, helically-wound spring steel, fibreglass, flexible plastics material, pre-stressed material, and other material which, when bent, are internally biased for returning to an unbent position.

In an embodiment such as shown in FIGS. 6A and 6B, each of the plurality of side struts 130 are pivotably connected to the bottom frame 240 for pivoting about the bottom frame 240. In the specific embodiments provided in FIGS. 6A to 6B, the circular through-channels 436 of the second ends 134 of each of the plurality of size struts 130 are sized to receive the bottom frame 240 therethrough such that the second end 134 of each of the plurality of side struts 130 is pivotably connected to the bottom frame 240.

Figure 8A:
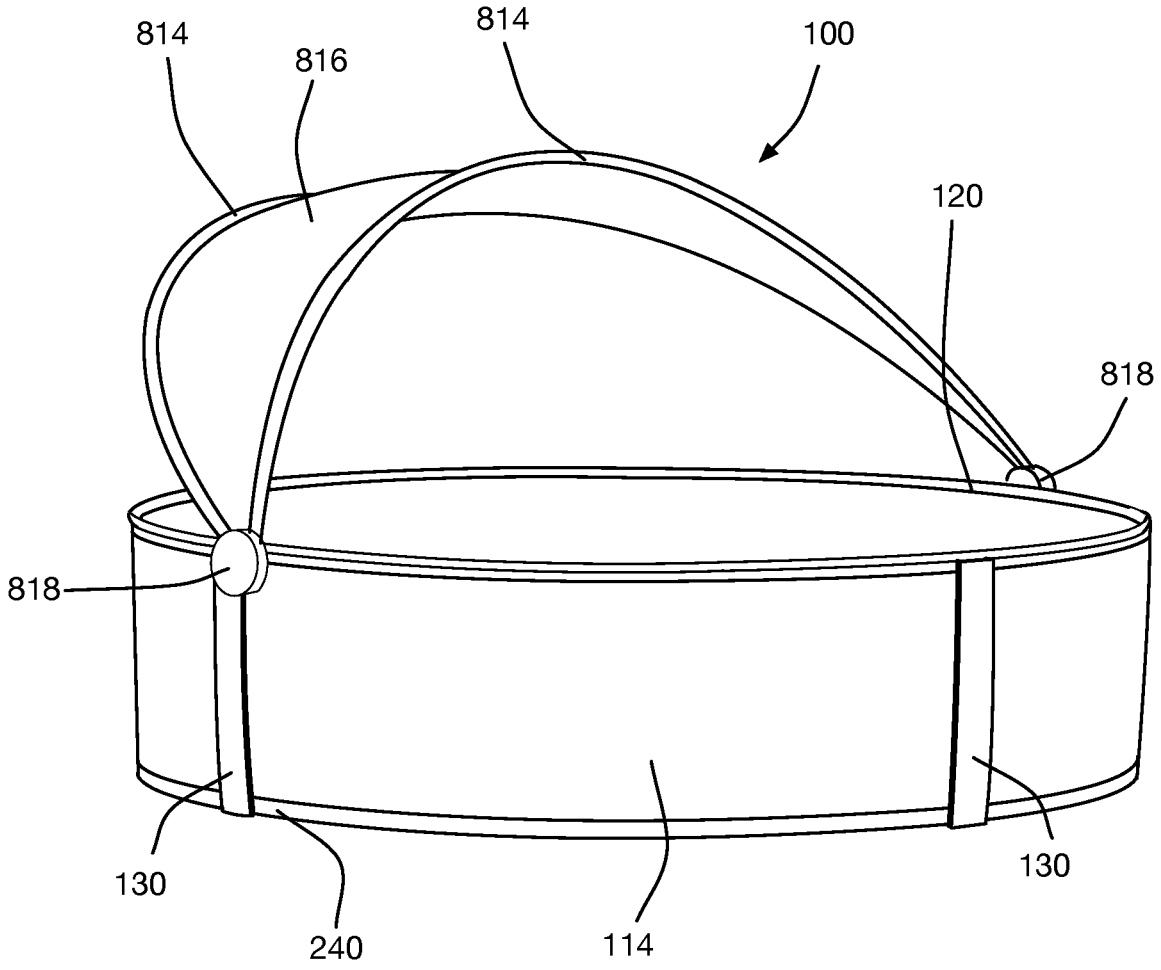
FIG. 8A shows a perspective view of an embodiment of the collapsible pool with a canopy structure where the canopy structure is in a first position.
Figure 8B:
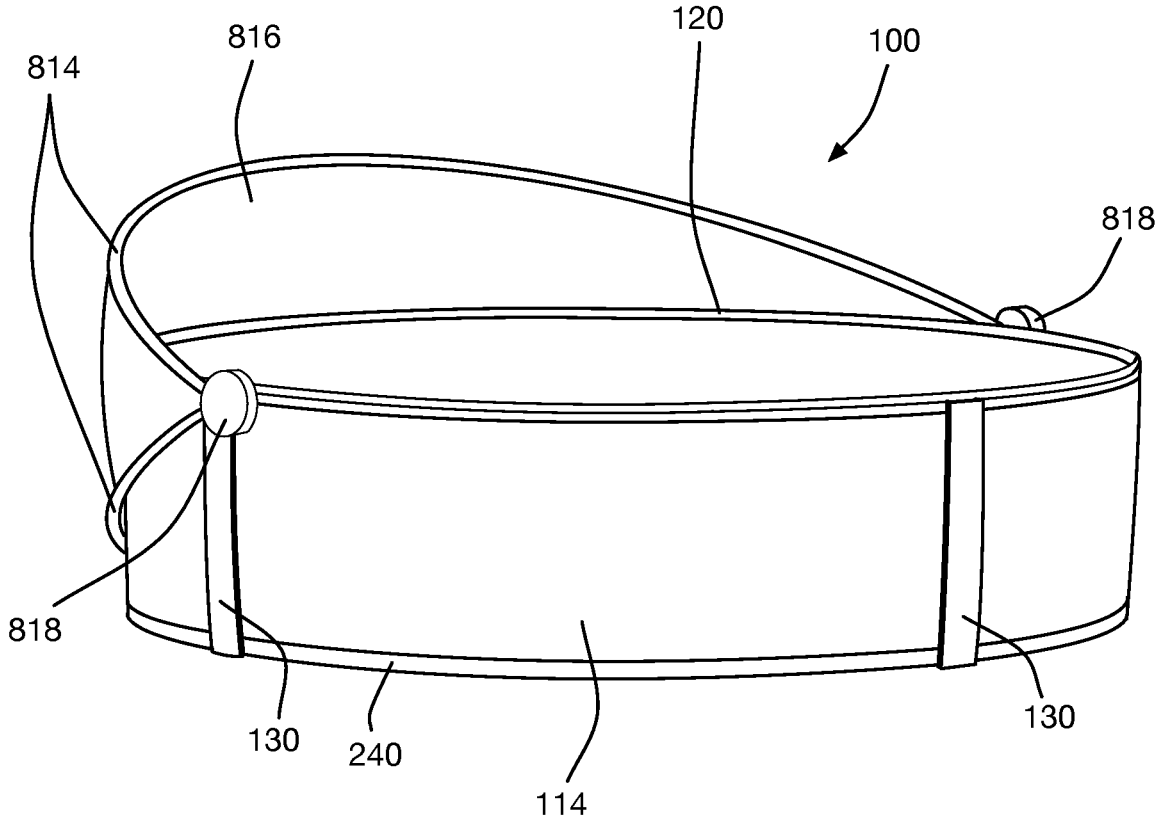
FIG. 8B shows a perspective view of an embodiment of the collapsible pool with a canopy structure where the canopy structure is in a second position.

Referring to the embodiment shown in FIGS. 8A and 8B, the collapsible pool 100 further includes a canopy structure 810 that provides shade to the collapsible pool 100. The canopy structure 810 is pivotably connected to the collapsible pool 100 for pivoting between a first, covering position where the canopy structure 810 is disposed above the collapsible pool 100, and a second, withdrawn position where the canopy structure 810 is positioned adjacent to the sidewall 114.

In an embodiment such as the embodiment shown in FIGS. 8A and 8B, the canopy structure 810 is a partial canopy structure that is formed to extend over a portion of the collapsible pool 100. The canopy structure 810 includes a canopy structure frame with a pair of arched supports 814 that support an area of shade material 816. The area of shade material 816 extends between, and is supported by the pair of arched supports 814 for providing shade to the collapsible pool 100. The pair of arched supports 814 are mounted between a pair of pivoting members 818. The pair of pivoting members 818 are pivotably connected to diametrically opposed regions of the collapsible pool 100. In the embodiment shown in FIGS. 8A and 8B, the diametrically opposed regions of the collapsible pool 100 are defined by the plurality of side struts 130, where the plurality of side struts 130 are equally spaced apart around the sidewall 114, and the pivoting members 814 of the canopy structure 810 are pivotably connected to at least two diametrically opposed side struts of the plurality of side struts 130.

In the specific embodiment of FIGS. 8A and 8B, each of the pair of pivoting members 818 includes a ratchet mechanism formed therein. The ratchet mechanism of each pivoting member 818 is attached to the top frame 120 and the pair of arched supports 814 and facilitates the pivoting of the canopy structure 810 between the covering position shown in FIG. 8A and the withdrawn position shown in FIG. 8B.

While the above embodiment is specific to the canopy structure 810 that includes the arched supports 814 and the pair of pivoting members 818 connected to the top frame 120, other embodiments of the canopy structure 810 on the pool may be provided where at least one of the arched supports 814 and the pair of pivoting members 818 is mounted to a section of the collapsible pool 100 that is disposed below the top frame 120, such as the sidewall 114 of the collapsible pool 100.

Figure 9:
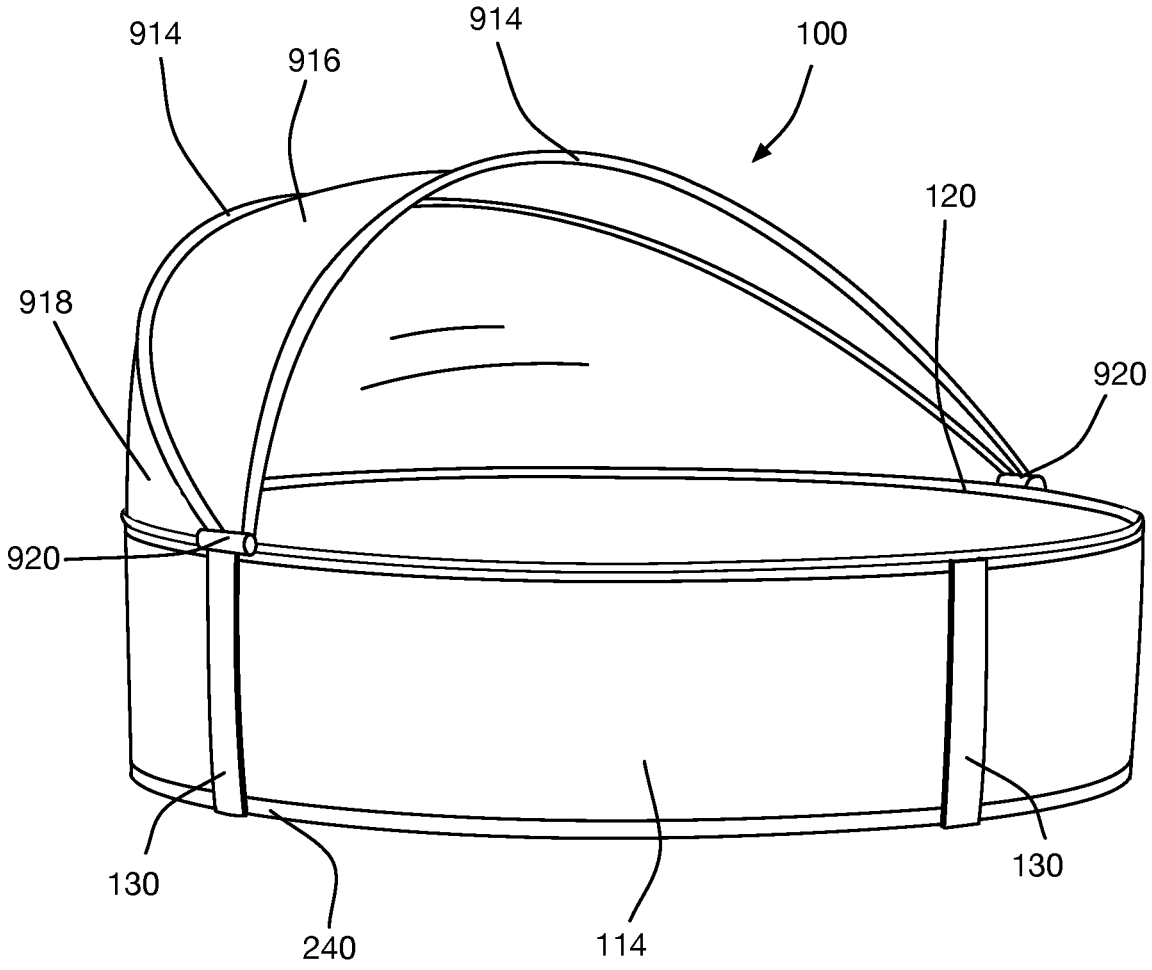
FIG. 9 shows a perspective view of an embodiment of the collapsible pool with a fixed canopy structure.

In the alternate embodiment provided in FIG. 9, the collapsible pool 100 further includes a canopy structure 910 that provides shade to the collapsible pool 100. In this embodiment, the canopy structure 910 is a fixed structure that is connected to diametrically opposed sections of the collapsible pool 100 via a pair of fixed connectors 920. When the canopy structure 910 is connected to the pool, it is maintained in a covering position where the canopy structure 910 is disposed above the collapsible pool 100. In the specific embodiment provided in FIG. 9, the pair of fixed connectors 920 are a pair of "snap-on" connections that can be snapped directly on the top frame 120 for securing the canopy structure 910 in place.

In an embodiment such as shown in FIG. 9, the canopy structure 910 is a partial canopy structure that is formed to extend over a portion of the collapsible pool 100. The canopy structure 910 includes a canopy structure frame with of arched supports 914 that support a first area of shade material 916 that extends therebetween. One of the ached supports 914 also supports one edge of a second area of shade material 918. A second edge of this second area of shade material 918 is secured to a length of the top frame 120 such that the second area of shade material 918 extends from the one arched support 914 down to the top frame 120 The first and second area of shade material 916, 918 extend between and is supported by the pair of arched supports 914 and the top frame 120 for providing shade to the collapsible pool 100. In an additional embodiment, the second edge of the second area of shade material 918 is wrapped around (not shown) and secured to an underside of a length of the top frame 120.

While the above embodiment is specific to the canopy structure 910 that is a partial canopy structure where the arched supports 914 and the second edge of the shade material 918 are both connected to the top frame 120, other embodiments of the canopy structure 910 on the pool may be provided where at least one of the arched supports 914 and the shade material 918 is mounted to a section of the collapsible pool 100 that is disposed below the top frame 120, such as the sidewall 114 of the collapsible pool 100.

The embodiments of the inventions described herein are exemplary (e.g., in terms of materials, shapes, dimensions, and constructional details) and do not limit by the claims appended hereto and any amendments made thereto. Persons skilled in the art will appreciate that there are yet more alternative implementations and modifications possible, and that the following examples are only illustrations of one or more implementations. The scope of the invention, therefore, is only to be limited by the claims appended hereto and any amendments made thereto.

The above-described embodiments are intended to be examples of the present disclosure and alterations and modifications may be effected thereto, by those of skill in the art, without departing from the scope of the disclosure that is defined solely by the claims appended hereto.

PART NUMBERS

100 Collapsible pool
102 Volume for holding water
104 Support surface
110 Pool wall
112 Base portion
112*a* Perimeter edge
114 Sidewall
120 Top frame
130 Plurality of side struts
132 First end
134 Second end
138 Strut
240 Bottom frame
320 Circular top ring
340 Circular bottom ring
432 Hooked member
434 Cylindrical end portion
436 Through-channel that is sized
532 Hooked element
524 Top pockets
534 Bottom pockets
810 Canopy structure
814 Arched supports
816 Area of shade material
818 Pivoting members
910 Canopy structure
914 Arched supports
916 Area of shade material
918 Pivoting members
920 Fixed connector

What is claimed is:

1. A collapsible pool for use on a support surface, the collapsible pool comprising:

a top frame that is transformable between a top frame use position where the top frame has a first top frame maximum cross-dimension and a top frame storage position where the top frame has a second top frame maximum cross-dimension that is less than the first top frame maximum cross-dimension;

a flexible pool wall for containing a volume of water, the flexible pool wall including a sidewall and a base portion, the sidewall being connected to the top frame; and a plurality of side struts each including a first end that is releasably connectable to the top frame and a second end that is pivotable between a support position for supporting the top frame in the top frame use position above the support surface and a stowage position in which the first end is disconnected from the top frame to permit transformation of the top frame from the top frame use position into the top frame storage position.

2. The collapsible pool of claim 1, wherein a length of each of the plurality of side struts is less than the second top frame maximum cross-dimension of the top frame.

3. The collapsible pool of claim 1, wherein the first top frame maximum cross dimension of the top frame is no more than 3 feet.

4. The collapsible pool of claim 1, wherein the top frame is formed such that when the top frame is in the top frame storage position, the top frame is coiled on itself in at least two turns.

5. The collapsible pool of claim 1, wherein the collapsible pool further comprises a bottom frame that is connected to at least one of the base portion and the at least one sidewall portion, the bottom frame being transformable between a bottom frame use position where the bottom frame has a first bottom frame maximum cross dimension that corresponds to the first top frame maximum cross dimension, and a bottom frame storage position where the bottom frame has second bottom frame maximum cross-dimension that corresponds to the second top frame maximum cross-dimension.

6. The collapsible pool of claim 5, wherein each of the top and bottom frames are composed of any one of spring steel, coiled spring steel, helically-wound spring steel, fibreglass, flexible plastics material, pre-stressed material, and other material which, when bent, are internally biased for returning to an unbent position.

7. The collapsible pool of claim 5, wherein the second ends of each of the plurality of side struts are pivotably connected to the bottom frame.

8. The collapsible pool of claim 5, wherein the sidewall and the base portion are attached around a perimeter edge of the base portion; and wherein the bottom frame is connected to the base portion and the sidewall at the perimeter edge of the base portion.

9. The collapsible pool of claim 5, wherein the first bottom frame maximum cross-dimension of the bottom frame is less than the first top frame maximum cross-dimension of the top frame.

10. The collapsible pool of claim 5, wherein the first bottom frame maximum cross-dimension of the bottom frame is substantially the same as the first top frame maximum cross-dimension of the top frame.

11. The collapsible pool of claim 5, wherein the second bottom frame maximum cross-dimension of the bottom frame is substantially the same as the second top frame maximum cross dimension of the top frame.

12. The collapsible pool of claim 1, wherein a top side of the at least one sidewall portion of the pool wall defines at least one pocket extending along a length of the sidewall, and wherein the at least one pocket is sized to receive and releasably hold the at least a portion of the top frame therewithin.

13. The collapsible pool of claim 1, wherein the top frame is a resilient top frame and the bottom frame is a resilient bottom frame.

14. The collapsible pool of claim 5, wherein each of the top frame and bottom frame are formed as resilient rings; and wherein each of the top frame and bottom frame have a circular cross-sectional shape.

15. The collapsible pool of claim 14, wherein the first end of each of the plurality of side struts includes a hook member that is sized to releasably connect around the top frame for releasably connecting the first end to the top frame.

16. The collapsible pool of claim 15, wherein the second end of each of the plurality of side struts includes a through-channel that is sized to receive the bottom frame therethrough such that each of the plurality of sides struts can pivot about the resilient bottom frame.

17. The collapsible pool of claim 1, further comprising a canopy structure for providing shade to the collapsible pool, the canopy structure being pivotably connected to the pool body for pivoting between a covering position where the canopy structure is disposed above the collapsible pool, and a withdrawn position where the canopy structure is positioned adjacent to the sidewall.

18. The collapsible pool of claim 17, wherein the plurality of side struts are equally spaced apart around the sidewall; and wherein the canopy structure is pivotably connected to at least two opposing side struts of the plurality of side struts.

* * * * *